United States Patent [19]

Chappell

[11] Patent Number: 4,474,307

[45] Date of Patent: Oct. 2, 1984

[54] DOWN FLOW APPARATUS FOR DISPENSING VISCOUS MATERIAL AND METHOD OF LOADING SAME

[75] Inventor: Albert R. Chappell, Godfrey, Ill.

[73] Assignee: The Metalife Company, Wetzville, Mo.

[21] Appl. No.: 292,299

[22] Filed: Aug. 12, 1981

Related U.S. Application Data

[63] Continuation-in-part of Ser. No. 229,626, Jan. 29, 1981, which is a continuation of Ser. No. 973,806, Dec. 28, 1978, abandoned.

[51] Int. Cl.[3] ..... B67D 5/42

[52] U.S. Cl. ..... 222/1; 222/181; 222/321; 222/383

[58] Field of Search ..... 222/325, 320–321, 222/383, 180–181; 141/2, 5, 7, 20.5, 18

[56] References Cited

U.S. PATENT DOCUMENTS

| | | | |
|---|---|---|---|
| 2,622,539 | 12/1952 | Martin | 222/341 X |
| 2,751,124 | 6/1956 | Jones | 222/181 X |
| 2,807,288 | 9/1957 | Shea | 141/18 |
| 3,321,111 | 5/1967 | Jellinek | 222/341 X |
| 3,446,405 | 5/1969 | McCray | 222/309 |
| 3,809,293 | 5/1974 | Chappell | 222/181 X |
| 3,952,918 | 4/1976 | Poitras et al. | 222/383 X |
| 4,120,429 | 10/1978 | Vignot | 222/321 X |
| 4,303,108 | 12/1981 | Akers et al. | 141/2 |

FOREIGN PATENT DOCUMENTS

| | | | |
|---|---|---|---|
| 255993 | 2/1949 | Switzerland | 141/20.5 |
| 211759 | 2/1968 | U.S.S.R. | 222/383 |

*Primary Examiner*—Charles A. Marmor
*Attorney, Agent, or Firm*—Jerome A. Gross

[57] ABSTRACT

Simple apparatus permits material, such as a hand cleaner whose viscosity is too great to flow downward under the force of gravity, to be loaded by inverting a can of the material and pressing downward onto the top of a reservoir sleeve. For pumped dispensing, two rubber valves of the "duck-bill" type are provided in the flow line downward from the reservoir bottom wall. While their lips are so soft as to be unable to restrain the down flow of conventional liquid, this is no problem when used with the viscous material. The material is dispensed by pumping until its level in the reservor is so low that an air channel forms downward through the material to the valved flow line, preventing further dispensing. At this stage, inverting and pressing downward a second can of material drives air in the reservoir downward through the air channel so formed and out through the soft rubber valves, so that dispensing can recommence.

1 Claim, 5 Drawing Figures

DOWN FLOW APPARATUS FOR DISPENSING VISCOUS MATERIAL AND METHOD OF LOADING SAME

CROSS-REFERENCE TO RELATED APPLICATIONS

This application is a continuation-in-part of U.S. application Ser. No. 229,626 filed Jan. 29, 1981, entitled "Horizontally-Operated Integrally-Molded Pump-Type Dispenser Having Improved Valve Access", now pending which is a continuation of application Ser. No. 973,806 filed Dec. 28, 1978, having the same title, now abandoned; and as to common subject matter the priority of those applications is claimed.

BACKGROUND OF THE INVENTION

A popular type of hand cleaner, used especially in factories, garages and other industrial and commercial establishments, is of a viscosity much like that of a pasty creme, too great to flow downward under the force of gravity. Dispensing such a material involves problems different from those of dispensing a flowable liquid. Loading and reloading of such dispensers has offered serious problems, particularly with regard to the channeling of air through the material on dispensing and the elimination of air in refilling dispensers.

Such hand cleaner material may be furnished in cylindrical cans; and these may be left in place over a cylindrical reservoir for the material, as shown in U.S. Pat. Nos. 2,818,998 to Jones and 3,809,293 to the present inventor. In the types of dispenser there shown, when the reservoir is partly filled an additional can of material may be so put in place over it, to descend as the material within the reservoir is pumped from it; this descent is caused by outside air pressure, acting against the vacuum induced by the dispensing action. In both of these patents the problem of charging a partially-filled dispenser and eliminating the air between the material already in the reservoir and the new material to be added is met by providing a vertical pipe within the reservoir, closed at its top end and having a series of orifices at its sides so that the intervening air, at any level, may be forced into the pipe and discharged downward during the filling operation. Of these patents, U.S. Pat. No. 3,802,293 shows that the viscous material may be drawn out by being pumped in a downward course leading from the bottom of the reservoir through a ball valve and thence pressed by a piston through a second ball valve to a discharge outlet.

SUMMARY OF THE INVENTION

The present invention provides much simplified apparatus and an entirely new method of loading and reloading the apparatus with such viscous material. With the present method and apparatus, it is preferred that the reloading (or at least a final act thereof) take place when the level within the reservoir is so low that pumping has formed an air channel through the material, preventing further dispensing. At this time the superimposed container of the material is merely pressed downward, driving out air through the air channel so formed and the two readily-opening rubber valves in the pumping system. This reloading takes place without any pumping action and without need for any such vertical air vent pipes.

To achieve the present method of dispensing material whose viscosity is too great to flow downward under force of gravity, I provide a dispenser similar in certain respects to those of the prior patents. Thus, the hollow cylindrical reservoir, presented vertically, has a vertical air inlet groove formed in its outer surface, and a notch in the upper cylinder edge connecting the groove to the interior, for communicating air flow. A bottom reservoir wall which supports the cylinder includes a valve, preferably formed integrally of a rubber-like material and popularly known as a "duck bill" valve, of sufficient capacity to permit down-flow of the material under vacuum caused by reciprocating a dispensing piston, which in the preferred embodiment operates on a horizontal axis forwardly of the valve outlet. The piston is hollow and communicates with the hollow of a piston rod leading outward to and through a dispensing knob. At the juncture of the hollow piston and rod there is housed a second valve of the same type, which because of the small space afforded must be substantially smaller; the force applied by the piston, and resisted on the closing of the first valve, may create a pressure substantially exceeding atmospheric pressure, which alone is availed of for driving the viscous material through the smaller valve.

Heretofore, the formation of an air channel through the material in the reservoir as its level lowered, was a serious problem. In using the present dispenser, the air channel, formed through the viscous material when its level in the reservoir is low, is utilized to facilitate reloading. Assuming reloading has been delayed to this point, a new can of material is applied by inverting and pressing down over the reservoir sleeve. Since the sleeve fits closely against the inner surface of the can of material, the material is readily introduced downward into the reservoir by manual pressure, and the intervening air above the level of the old material is easily driven out by such pressure through the two valves.

If, however, the user has preferred not to wait until the air channel forms, but places a new can of material on top of the reservoir prior to such channeling, the intervening air cannot be driven out; the can may move down only slightly below the top edge of the reservoir sleeve, leaving a large amount of air intervening. After this, drawing the material from the dispenser will cause the newly added can of material to telescope gradually downward, with its material separated from that already in the reservoir by the intervening air. As soon as the level of the material previously within the reservoir has lowered sufficiently to form an air channel, the dispensing will stop until the air below the newly added material is exhausted. This is done readily by applying manual pressure at that time to the bottom of the can, quickly driving the air through two duck bill valves in the dispensing passage.

DESCRIPTION OF THE PREFERRED EMBODIMENT

Figure 1:
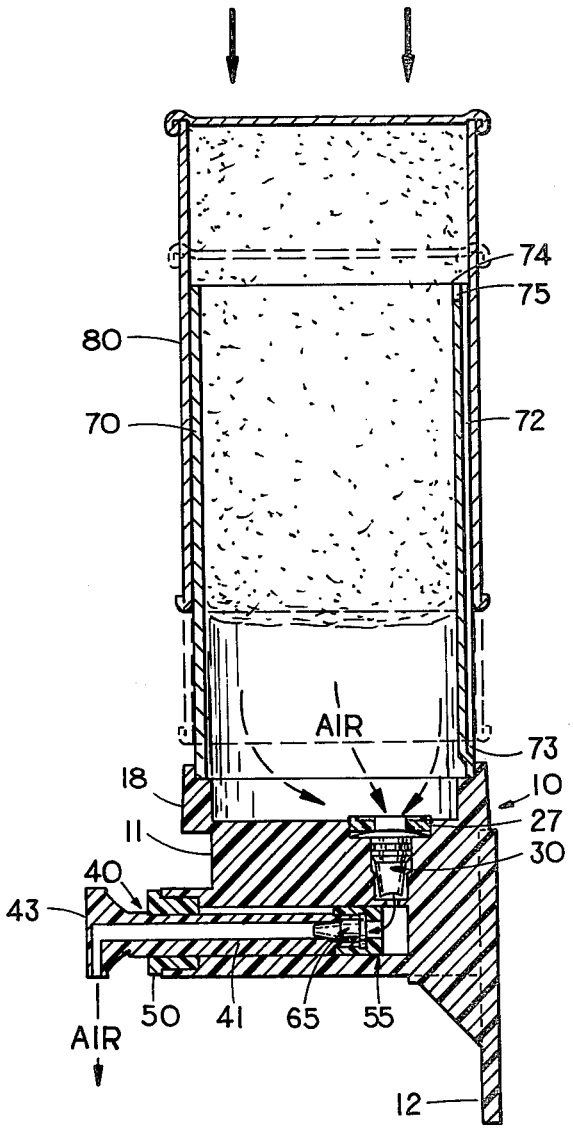
FIG. 1 is a side view, principally in section, showing a preferred embodiment of the present invention, with a can of material being supplied to fill an empty dispenser, air being driven out through the valves. The phantom lines show the final position of the can.

The wall-mounted dispenser shown in the drawings has a dispenser body generally designated 10 preferably formed by molding a conventional plastic material suited to the proportions described, Such as hardened polyethylene. It has a generally cylindrical body portion 11 backed by an integral flat wall flange 12. The generally cylindrical body portion 11 is formed about a vertical axis, not shown. Near its lower end, the body 10 has a forwardly projecting horizontal cylindrical boss 13 formed about the axis of a pump bore 14 which penetrates about two-thirds or more of the diameter of the body portion 11. At the forward end of the pump bore 14 is a counterbore portion 15.

At its upper end, a circular upper surface 17 of the dispenser body 11 is provided, referred to hereinafter as the bottom wall of the reservoir. It is surrounded by an upstanding reservoir mounting flange 18.

Molded in the dispenser body and extending downward from the surface 17 to the rear end of the pump bore 14 is a downflow passage 21 having a counterbore portion 22 extending downward from the reservoir bottom wall 17 and threaded as shown. The intersection of the downflow passage 21 with the counterbore 22 provides a shoulder 24. The downflow passage 21 has a bottom outlet 25 into the aft end of the horizontal pump bore 14.

A molded plastic externally-threaded hold-down washer 27, which screws into the counterbore 22, holds in place the larger of two valves used in the dispensing apparatus. The preferred valve is of the "duck-bill" type, generally designated 30. It is molded of soft, natural or synthetic rubber material, and has a hollow cylindrical body portion 31 molded with an integral upper flange 32 seated against the shoulder 24, and integral soft lips 33 which project downstream toward the bottom outlet 25 of the downflow passage 21.

Mounted in the pump bore 14 is a piston assembly generally designated 40. It includes a piston rod or plunger 41 having a discharge passage 42 which extends longitudinally forward through it and then downward through a forward end knob portion 43 to a discharge outlet 44. The inner end 46 of the piston rod 41 is externally threaded.

In the embodiment shown, the hollow plunger 41 has along its lower edge a longitudinal rib 48 which is accommodated in a notch 49 formed in a hollow cylindrical retainer plug 50 fitted into the counterbore 15 and there retained, as by a removable screw, not shown. The retainer plug functions also as a guide to the plunger 41, while its notch 49 holds the plunger from rotation so that its discharge outlet 44 will always be presented downward.

Onto the inner end 46 of the plunger 41 is fitted a hollow cylindrical piston generally designated 55 penetrated by an axial bore 56 and having an exterior piston seal 57, such as an O-ring fitted within a groove; the piston 55 also has a counterbored threaded inner end 58, the counterbore providing a shoulder 59 at its juncture with the bore 56. The shoulder 59 is spaced from the edge of the piston rod inner end 46 sufficiently to provide a shallow annular cavity which accommodates the annular flange 64 of a smaller valve generally designated 65, whose construction is generally similar to the larger valve 30. Thus, the smaller valve 65 has a hollow cylindrical body portion 66 terminating in molded lips 67 which extend downstream, the body 66 and lips 67 being accommodated within the discharge passage 42 of the plunger 41.

Mounted on the dispenser body 10 within the reservoir mounting flange 18 is a generally cylindrical metal reservoir sleeve 70. Its lower circular edge 71 is retained at the reservoir mounting flange 18. As shown above the top edge of the mounting flange 18, the wall of the sleeve 71 has a vertical inwardly-formed air-conducting groove 72 leading from a lower inlet 73 upward to an inlet notch 75 in the reservoir upper edge 74.

The material to be dispensed is furnished in cylindrical cans 80 shown schematically and not part of this invention other than in its use in the method hereof. As shown in the drawings, the can 80 is of such height that when inverted and pressed down, the outer surface of the reservoir sleeve will slide closely against the inner surface of the wall of the can 80, and when its bottom surface rests against the upper edge of the upper edge 74 of the reservoir sleeve, the mouth of the can 80 will be sufficiently above the reservoir mounting flange 18 as to leave open the lower inlet end 73 of the groove, for supply of air therethrough.

The arrangement of the two valves 30, 65 is superficially familiar; they are arranged in a flow line in pumping relationship relative to each other. In fact, they would not in this arrangement perform a usual pumping function; because their lips 33, 67 are so softly resilient as to be incapable of themselves restraining the downflow of a liquid if filled within the reservoir 70. However, when used with a material whose viscosity is too great to flow downward under force of gravity, such as the pasty hand cleaners heretofore referred to, there is no need for secure closing. Furthermore, the larger valve 30 must have sufficient flow capacity so that the small amount of vacuum, furnished by the atmospheric pressure when the piston assembly 40 is drawn forward, will permit downflow through the valve lips 32. Persons skilled in the art will recognize that greater than atmospheric pressure is available to open the lips 67 of the smaller valve 65; because for this purpose all the force which may be exerted manually on the knob 43 is available. Accordingly, the valves 30, 65 are molded of the same soft rubber or rubber-like compounds with their lips 33, 67 presented against each other lightly.

Figure 2:
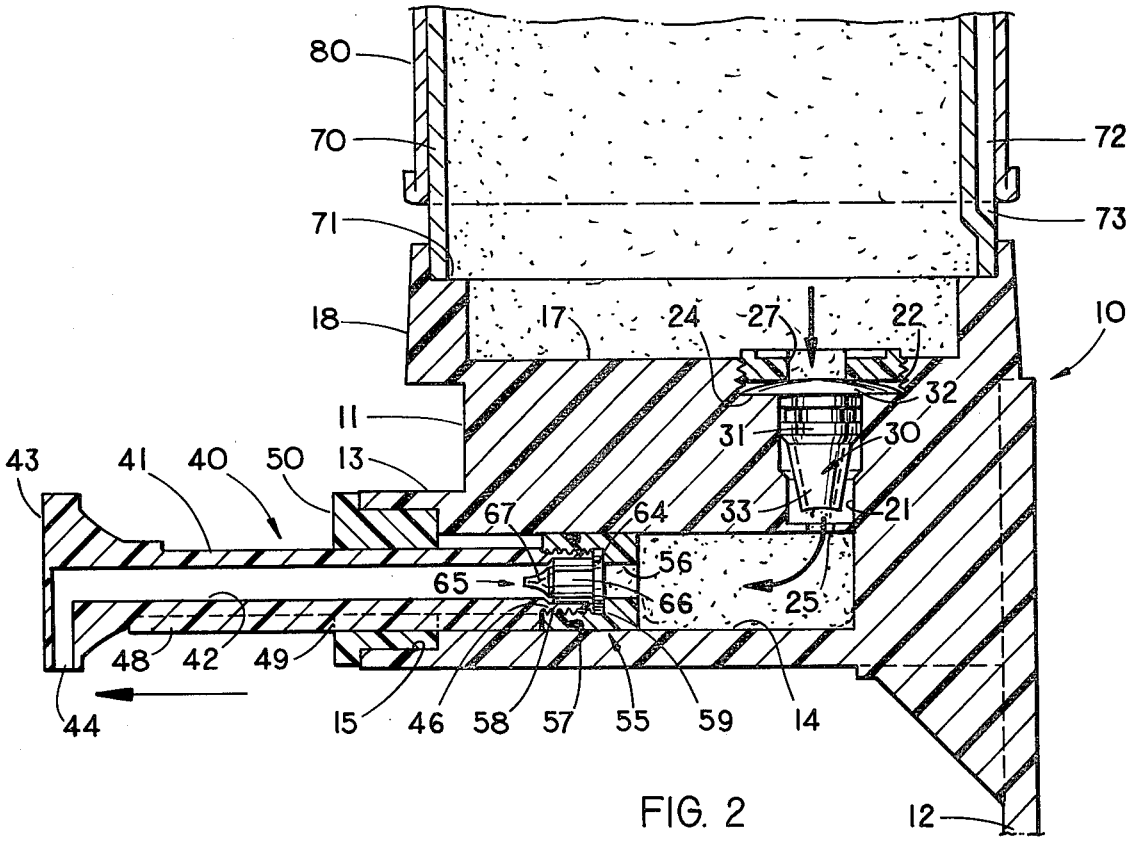
FIG. 2 is an enlarged detail view, after filling, of the dispenser of FIG. 1, showing the piston drawn forward to commence dispensing.

The foregoing description shows that the present dispenser, though intended to dispense material whose viscosity is so great as to defy dispensing by ordinary means, nevertheless has fewer parts than conventional dispensers and substantially fewer parts than prior dispensers for such special material. To operate with such simplified construction, the following method is used:

As seen in FIG. 1, a can of the material too viscous to flow under force of gravity is inverted and pressed downward about the reservoir sleeve 70. Since the inner diameter of the sleeve 70 is somewhat less than the inner diameter of the can, the material will be slightly in advance of the mouth of the can. As pressed downward with manually exerted force, illustrated by the downward arrows above the can in FIG. 1, air in the empty dispenser will be driven out, dilating and passing through the lips of the valve 30, 65; and for this purpose the piston assembly 40 may remain in its normal retracted position as shown. When the air is driven out, the material will fill the reservoir. Thereafter when the piston plunger 41 is drawn forward as shown in FIG. 2, air under atmospheric pressure entering through the inlet 73 of the groove 72 will exert atmospheric pressure on the material, so that the readily opening larger valve 30 will be dilated as the piston assembly 40 is drawn forward. As this assembly is drawn forward, the lips 67 of the smaller valve 65 are driven sealedly against each other.

Figure 3:
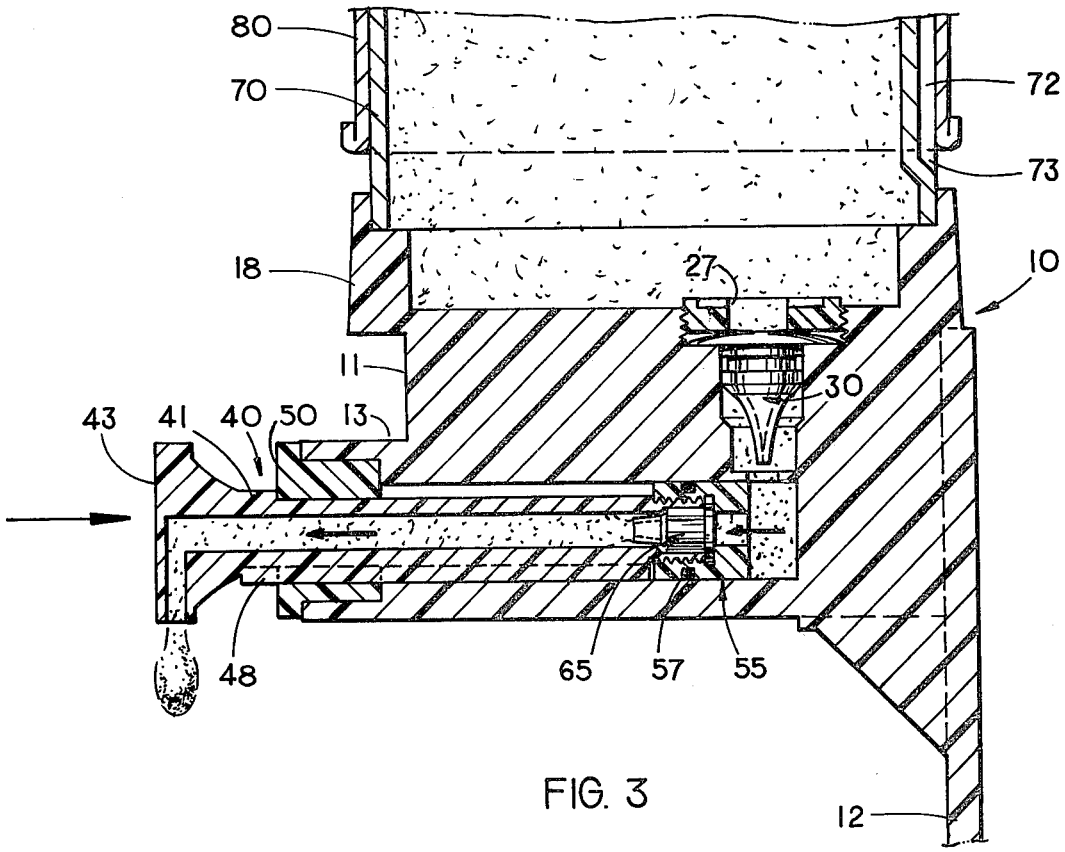
FIG. 3 is a detail view similar to FIG. 2, with the dispensing piston pushed back, thus applying superatmospheric pressure to close the first valve in the line of flow and dispense the material through the valve in the piston.

Thereafter, as shown in FIG. 3, when the knob 43 is driven backward, the piston 55 will exert pressure on the material behind it in the pump bore 14, causing the lips 33 of the larger valve 30 to be pressed tightly together while the pressure simultaneously opens the lips 67 of the smaller valve and causes the material to pass forwardly through discharge passage 42 and out the discharge outlet 44. The material is dispensed by continued forward-and-aft strokes of the piston assembly 40, with the air which enters through the groove 72 and the reservoir sleeve 70 continuing to supply atmospheric pressure on the upper surface of the material within the reservoir.

Figure 5:
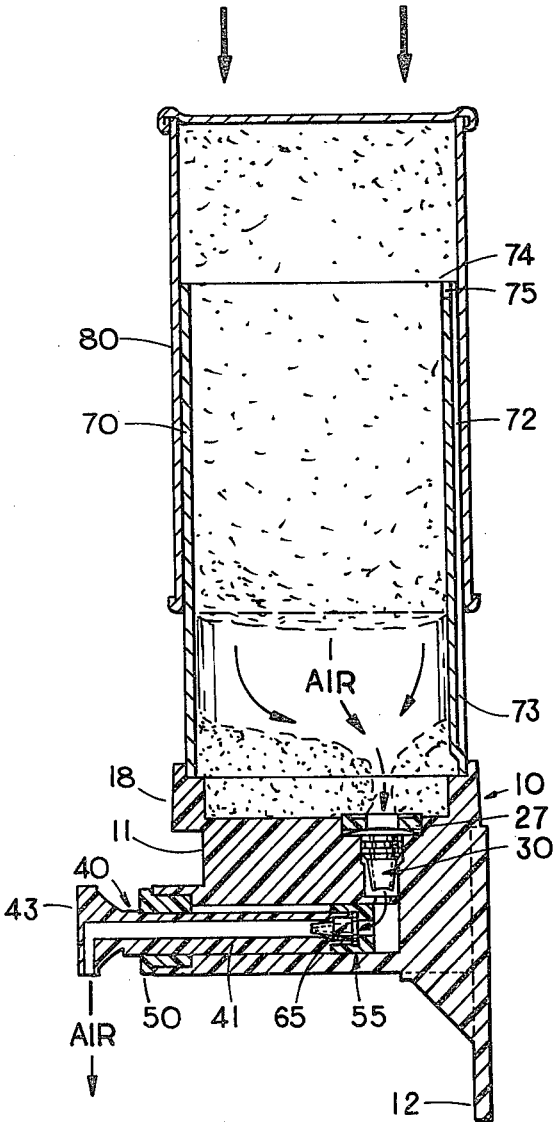
FIG. 5 illustrates how, after an air channel has formed as in FIG. 4, supplying a new can of material drives out the air through the air channel, so that dispensing may recommence as in FIG. 2.
Figure 4:
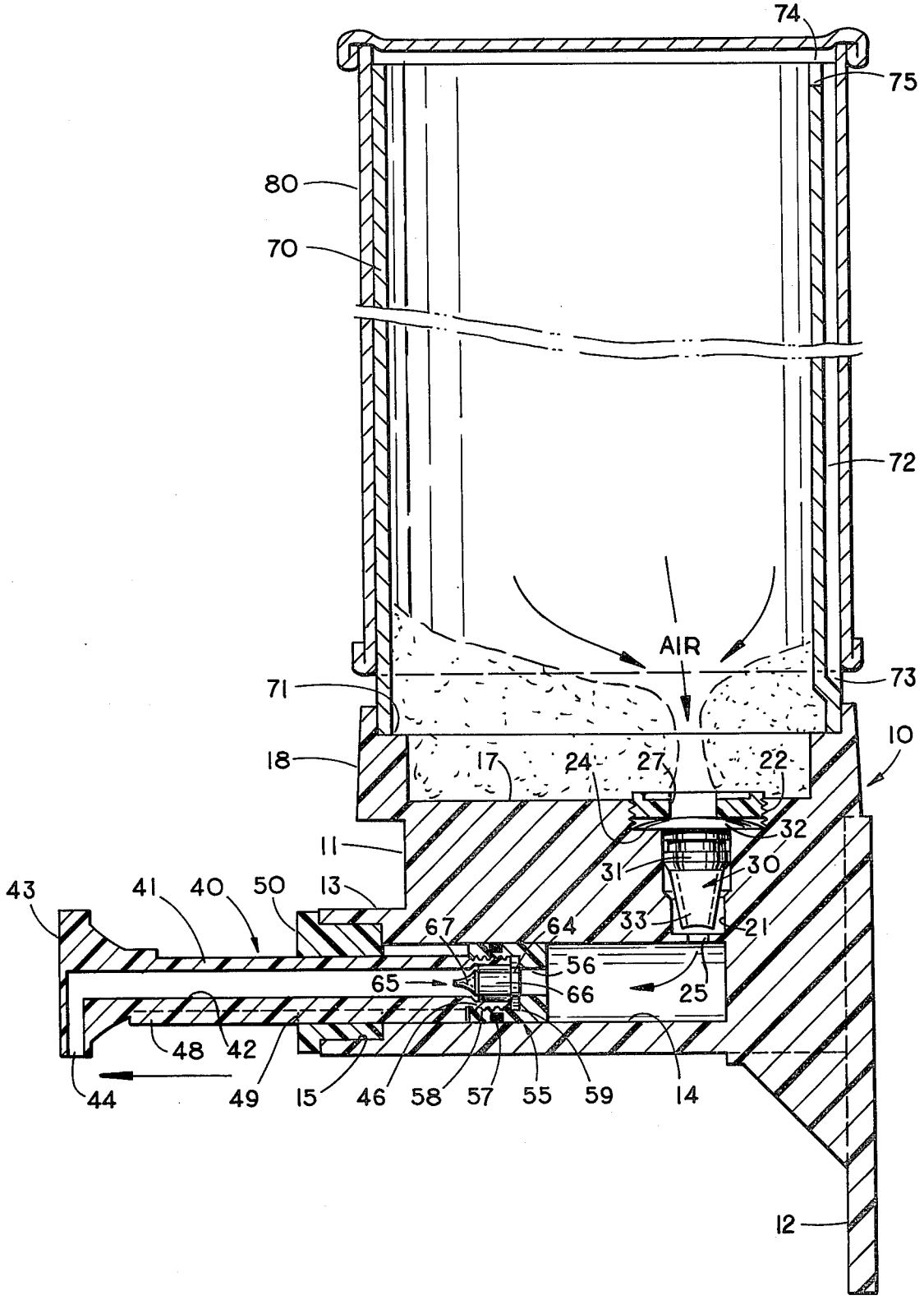
FIG. 4 illustrates how, when the level of the material has lowered sufficiently, drawing the piston forward will form an air channel through the material, thus terminating dispensing.

When the level of the material lowers to about 10% to 20% of the depth of the reservoir (depending on consistency of the material, height of the reservoir and other obvious considerations) at some such level air will "channel" through the material as shown in FIG. 4, so that it is impossible to draw any more of the contents outward through the dispensing system. At this point, assuming there has not been any prior effort to refill the reservoir, a new can of material is inverted over the reservoir and driven downward as shown in FIG. 5; and it is pressed downward with a manually-applied force, this creating a superatmospheric pressure. The air channel which has so interrupted dispensing now provides a channel of out-flow for the air which had theretofore filled the top of the reservoir sleeve 70. This air flows out readily through the air channel and through the two valves as shown in FIG. 5 until the can is so lowered that its contents fill the reservoir, eliminating the air channel. Thus, pumped dispensing may be resumed.

The prior art dispensers referred to at the beginning of this specification were intended to make it possible to add a second can of the material while the reservoir contents were still substantial, that is, before such an air channel had formed. To achieve that advantage, the prior art dispensers were much more complicated to build. Such advantage can be achieved only in part with the present dispenser; to add such a second can of material, it may be inverted and pressed down slightly below the top edge of the reservoir sleeve 70 and left in place, to descend gradually on the cushion of air between it and the material therebeneath, as that lower material is gradually dispensed. If this method of operation is utilized, once the air channel forms as in FIG. 5, the user merely applies a slight manual force on the top of the can, driving out the intervening air through the air channel so that the dispensing may be recommenced.

Thus, using material which is too viscous to flow under force of gravity, I have taken advantage of the use of rubber-like valves whose lips are too soft and flaccid to restrain downflow of an ordinary liquid. The prior art recognized that such valves might be used for pump dispensers of the upflow type, but this would require at least a dip tube to conduct the liquid upward; and such dip tubes are a source of service difficulties, being likely to come loose. Accordingly, the present invention serves the purpose of dispensing a material which cannot be handled in ordinary dispensers, yet with fewer parts than ordinary dispensers require.

While the claims speak of material whose viscosity is too great to flow downward under force of gravity, it is understood that this is a generalized description of materials which do not flow readily under force of gravity under ordinary conditions of temperature and the like. The reference in the claims to "manual application of super-atmospheric pressure" means the addition of a small positive force, readily applied by hand, to supplement the atmospheric pressure present.

The principle manifest in the present invention may be utilized with other positioning of component parts, such as the second valve and the flow outlet; thus, they need not be in the piston but may be in some cases advantageously located elsewhere in the line of flow. However, the present arrangement is particularly advantageous because there is no tendency of viscous material to drip out of the horizontal flow passage 42. Nevertheless, from this specification, modifications will be apparent to persons skilled in the design and construction of dispensers.

I claim:

1. The method of driving out air while loading and re-loading creamy material whose viscosity is too great to flow downward under force of gravity, into a dispenser of the type having a reservoir and, in the line of flow therefrom to a discharge outlet, two valves and a reciprocating piston between the valves adapted to open and close the valves alternately, the valves being of the type having rubber-like lips too soft to restrain downflow of a liquid, comprising the steps of introducing into the reservoir from above, such material in a quantity sufficient to fill the reservoir to such level as will avoid channeling of air through the material to the line of flow, pressing such material toward the reservoir bottom and thereby causing both the valves to open simultaneously and the intervening air beneath such material to be driven out therethrough, and then, on dispensing the material by reciprocating the piston until the material level so lowers that a downward leading air channel forms to the line of flow, repeating the said steps of introducing, pressing and causing both valves to open simultaneously, thereby driving out the intervening air between such added quantity of material and any material already in the reservoir.

* * * * *